US006691665B2

(12) United States Patent
Gray et al.

(10) Patent No.: US 6,691,665 B2
(45) Date of Patent: Feb. 17, 2004

(54) DUAL AIR INDUCTION ARRANGEMENT

(75) Inventors: Charles Ernest Gray, White Lake, MI (US); Cape Alan Hall, Rockwood, MI (US); Lloyd Bozzi, Ypsilanti, MI (US); Takeshi Abe, Garden City, MI (US); Vincent Paul Solferino, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 15 days.

(21) Appl. No.: 09/682,695

(22) Filed: Oct. 5, 2001

(65) Prior Publication Data

US 2003/0066503 A1 Apr. 10, 2003

(51) Int. Cl.[7] ..... F02B 75/06
(52) U.S. Cl. ..... 123/192.1; 123/198 F
(58) Field of Search ..... 123/192.1, 198 F, 123/48 B, 48 A, 184.31

(56) References Cited

U.S. PATENT DOCUMENTS 4,318,371 A * 3/1982 McFarland ..... 123/192.1
4,461,248 A * 7/1984 McFarland, Jr. ..... 123/192.1
4,731,995 A * 3/1988 McFarland, Jr. ..... 123/192.1
4,829,941 A * 5/1989 Hitomi et al. ..... 123/192.1
4,846,117 A * 7/1989 Hitomi et al. ..... 123/192.1
4,981,115 A * 1/1991 Okasako et al. ..... 123/192.1
5,133,307 A * 7/1992 Kurihara ..... 123/192.1
5,447,128 A * 9/1995 Spinelli ..... 123/192.1
5,515,822 A * 5/1996 Kobayashi et al. ..... 123/192.1
5,638,785 A 6/1997 Lee
5,924,398 A * 7/1999 Choi ..... 123/192.1
5,960,750 A * 10/1999 Kreuter ..... 123/48 B
6,024,188 A * 2/2000 Yamaguchi et al. ..... 123/192.1
6,463,902 B1 * 10/2002 Curtis et al. ..... 123/192.1

* cited by examiner

*Primary Examiner*—Henry C. Yuen
*Assistant Examiner*—Jason Benton

(57) ABSTRACT

An air induction arrangement 7 for a variable displacement engine is provided. The air induction arrangement 7 includes first and second plenums 22, 24 fluidly connected to respective first and second throttles 26, 28. The first and second throttles 26, 28 are connected to respective first and second inlets 44, 60. In partial operation, the air induction arrangement 7 induces air into the first plenum 22. In higher power demand operation, the air induction arrangement 7 additionally induces air through the second plenum 24. There is a reduction of the cancellation of acoustic output between the first and second inlets 44, 60 so that an acoustic output of the engine 14 operating with only a first group of cylinders 16 is similar to the acoustic output of the engine when the engine is operating with both groups of cylinders 16, 20.

35 Claims, 6 Drawing Sheets

DUAL AIR INDUCTION ARRANGEMENT

BACKGROUND OF INVENTION

This invention relates to a reciprocating piston internal combustion engine utilizing an air induction arrangement and in particular, to an air induction arrangement utilized on a variable displacement reciprocating piston engine having cylinder deactivation.

Four-stroke, multiple-cylinder, reciprocating piston internal combustion engines used in automobiles are capable of being operated over great speed and load ranges. Those skilled in the art have recognized for years that lower specific fuel consumption is usually achieved when an engine is operated at a relatively high load. This is particularly true for spark ignition engines because throttling losses are minimized when the engine is operated at or near wide open throttle at full load conditions. Unfortunately, engines are frequently required to operate at less than maximum load. When an engine operates at partial load, fuel economy suffers because of the pumping loss. Therefore, it is desirable to avoid partial load operation of the engine.

Engines have been designed that avoid partial load operation by deactivating selected cylinder combustion chambers to allow the remaining active chambers to be operated at higher loads. Such engines are often referred to as variable displacement engines. Deactivation of the cylinders is typically achieved by a lost motion rocker arm assembly which can be selectively disabled, therefore allowing the valves associated with the given cylinder to remain in a deactivated open or closed position regardless of the position of an associated cam shaft.

Reciprocating piston internal combustion engines typically tend to be very loud. To lower the noise associated with such engines, the engine exhaust is connected to a muffler. Reciprocating piston engines also make noise about their inlets. To modify and/or lower the noise associated with the engine inlets, resonators can be provided.

Many variable displacement engines are built in a V configuration, which has two banks of cylinders corresponding to the different arms of the V. One bank comprises a first group of cylinders. A second opposite bank comprises a second group of cylinders. When there is a low power demand on the engine such as when the vehicle is idling or cruising on a highway, only one group of cylinders is operational. During high power demand, such as acceleration, both banks or groups of cylinders will be utilized to power the engine. An example of such an engine is a variable displacement V-10 engine. By selectively disabling one bank of the V-10 engine, the V-10 engine essentially operates as an inline five-cylinder (I5) engine.

Increasingly, vehicle operators are not only concerned with the volume of sound which emanates from the vehicle's power plant, but also are highly influenced by the quality of sound. In premium luxury vehicles, a quality sound is usually defined as a quiet sound which is least perceptible. In sportier and/or high performance vehicles, a quality sound is a roar that occurs during acceleration. If quality is defined as a quiet sound, sound quality improves as the number of cylinders in an engine increases. If quality is defined as a roaring powerful sound, good sound quality is often achieved with a smaller displacement engine such as a five-cylinder configuration.

When a vehicle is being powered by an I5 engine, a waterfall plot (FIG. 4) of engine noise will show the most dominant acoustic output at a 2.5 engine mode. In a five-cylinder engine, 2.5 cylinders will fire for every single rotation of the crankshaft. Accordingly, the predominant sound power output will be at the 2.5 mode and at multiples thereof at 5 mode and 7.5 mode. In a V-10 engine, the most dominant sound power output (FIG. 3) will be at 5 mode engine order. The V-10 engine can be quieter than a comparable I5 engine (FIG. 5) at the same operating conditions. An I5 engine sound as previously mentioned is considered superior for a performance vehicle. Therefore, if a V-10 variable displacement engine is being utilized, it is desirable that the engine sound like two separate I5 engines rather than one V-10 engine.

To encourage acceptance of vehicles with variable displacement engines, it is desirable that the transition between five-cylinder operation and ten-cylinder operation of the engine be imperceptible to the vehicle driver. When a vehicle with a variable displacement V-10 engine is first started, one bank of cylinders will be deactivated. The engine, when idling, will be in an I5 mode of operation. As the vehicle accelerates, the second bank of cylinders is activated, and the engine will function as a V-10. When the vehicle has fully accelerated to highway speeds, the engine will revert back to an I5 operation to maximize fuel economy.

In order for the transitions to be imperceptible to the driver, it is important that the engine sound the same when operating in an I5 mode of operation or a V-10 mode of operation. Transition between I5 and V-10 modes of operation can occur at any point between approximately 1,500 and 3,000 rpm depending upon other factors programmed into the engine controller. If the transition occurs at approximately 2,100 rpm there will be an approximately 15 decibel difference in the sound of the inlet from the transition between I5 operation and V-10 operation. If is desirable to reduce this differential.

Several techniques are available to match the engine mode sound characteristics between I5 and V-10. One method is to attenuate all inlet noise. However, this method requires utilization of very large resonators and eliminates all sound character from the intake inlet. A second method attempts to match the V-10 sound quality while the engine operates in the I5 mode. This method also requires large resonators, which were found to be undesirable. Additionally, the vehicle engine sound assumes more of the sound quality of V-10 engine operation. As mentioned previously, the V-10 sound output was considered to be undesirable.

Referring back to FIG. 5, if the engine has one inlet in I5 wide open throttle (WOT) operation the noise output of the inlet is generally higher. The V-10 WOT operation of the engine will have a lower noise output due to the acoustic cancellation in the induction arrangement.

In a move towards a preferred embodiment of the present invention, a second separate inlet is provided. The inlets are connected to a dual plenum intake manifold. The cylinders on one engine bank are connected to a first plenum and the first intake. The cylinders on the second engine bank are connected to the second plenum and the second intake. This air induction arrangement in the I5 mode has the sound of an I5 engine. However, in the V-10 mode, when both cylinder banks are operating, acoustic cancellation can occur resulting in the aforedescribed V-10 sound output. Accordingly, transition from I5 mode to V-10 mode tends to have the aforedescribed high decibel differential in its sound output.

It is desirable to provide a variable displacement engine which has the sound characteristic of an engine with half the cylinders. It is also desirable to provide a variable displacement engine that has transition from partial utilization of the cylinders to full utilization of the cylinders that is virtually imperceptible to the vehicle driver.

SUMMARY OF INVENTION

In a preferred embodiment, the present invention has an engine with an air induction arrangement having a first inlet. The first inlet is connected to a first group of cylinders via a first throttle and a first plenum. A second inlet is connected to a second plenum and a second group of cylinders.

At low engine power demand, the engine operates with the first group of cylinders. Selectively, when more power is required, the engine will additionally operate the second group of cylinders. During the low power operation, air will be induced into the first plenum via the first inlet and first throttle. This will cause the engine to operate as an I5 mode (assuming the engine is a V-10). When the engine requires more power, the second group of cylinders will also operate the engine and air will be induced into the second plenum via the second inlet and second throttle.

The cancellation of acoustic output between the first and second inlets is reduced so that when the engine is operating with the first and second groups of cylinders, it sounds like an engine operating with only the first group of cylinders. Accordingly, the transition between I5 and V-10 modes of operation is less perceptible or totally imperceptible to the vehicle operator. Cancellation of acoustic output between the inlets is reduced by either physically separating the inlets or, as described in one embodiment of the present invention, the first inlet is selected to have a slightly smaller diameter than the second inlet. Accordingly, cancellation of acoustic output between the inlets is greatly reduced and this reduction is generally constant over a large engine rotational speed operation range.

The present invention brings forth an advantage of a variable displacement engine whose sound output does not materially change during the transition from partial cylinder operation to full cylinder operation. Additionally, the variable displacement engine of the present invention has an advantage of giving a sportier sound quality which allows the engine to have a roar during acceleration which is typically not available with engines having such a large amount of cylinders.

Other advantages of the present invention will become more apparent to those skilled in the art from a reading of the following detailed description and upon reference to the drawings.

DETAILED DESCRIPTION

Figure 1:
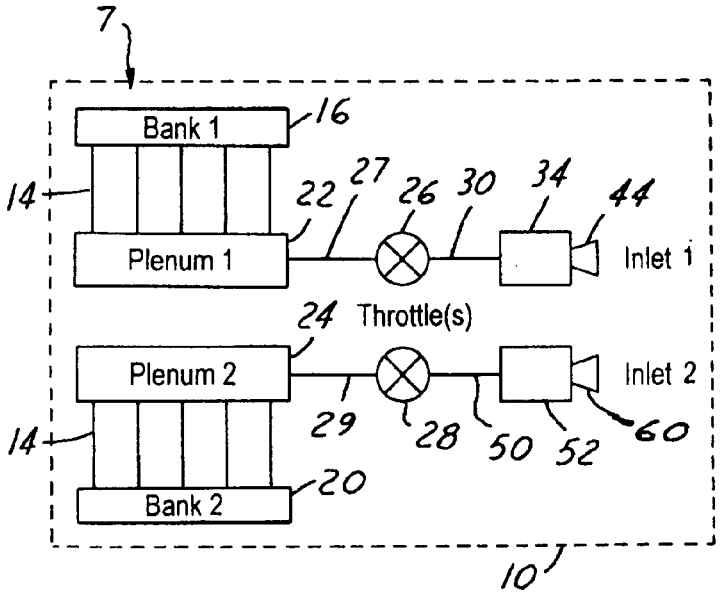
FIG. 1 is a schematic view of an automotive vehicle engine with an air induction arrangement according to a preferred embodiment of the present invention.

In FIGS. 1, and 7–11 an arrangement of an automotive vehicle 7 has an engine compartment 10, the boundaries of which are only partially shown. Mounted within the engine compartment 10 is a reciprocating piston internal combustion engine 14. As shown, the engine 14 has a V configuration having a first bank of cylinder combustion chambers 16. The engine 14 also has a second bank of cylinder combustion chambers 20.

Referring to FIG. 1, the first bank of cylinders 16 are connected to a first plenum 22. The second bank of cylinders 20 are connected to a second plenum 24. The first plenum 22 is connected to a first throttle 26 via an air line 27. The second plenum 24 is fluidly connected with a second throttle 28 via an air line 29. The first throttle 26 is connected to an air line 30. Referring additionally to FIGS. 7011, air line 30 is connected to a neck 32. The neck 32 is connected with a first air filter housing 34. The air filter housing 34 has a top half 36 which is fitted on a lower half 38. A button and snap connection 40 snaps the halves 34, 36 together. Fitted within the halves 36, 38 is an air filter media 42.

Extending from the lower half 38 is a first inlet snorkel 44. The lower half 38 also has extending rearwardly therefrom a vapor ventilation tube 46 to allow for the escape of entrapped moisture. The first inlet snorkel 44 has an opening 48.

The second throttle 28 is connected by a second intake air line 50 with a second air filter housing 52. Air filter housing 52 has a neck 54, a top half 56 and a lower half 58 substantially similar to those described in regards to the first air filter housing 34. Additionally, the second air filter housing 52 has an air filter 42. The second air filter housing 52 has a second inlet snorkel 60 with an opening 62. The opening 48 is approximately 5 to 6 mm smaller in diameter than the opening 62.

Figure 6:
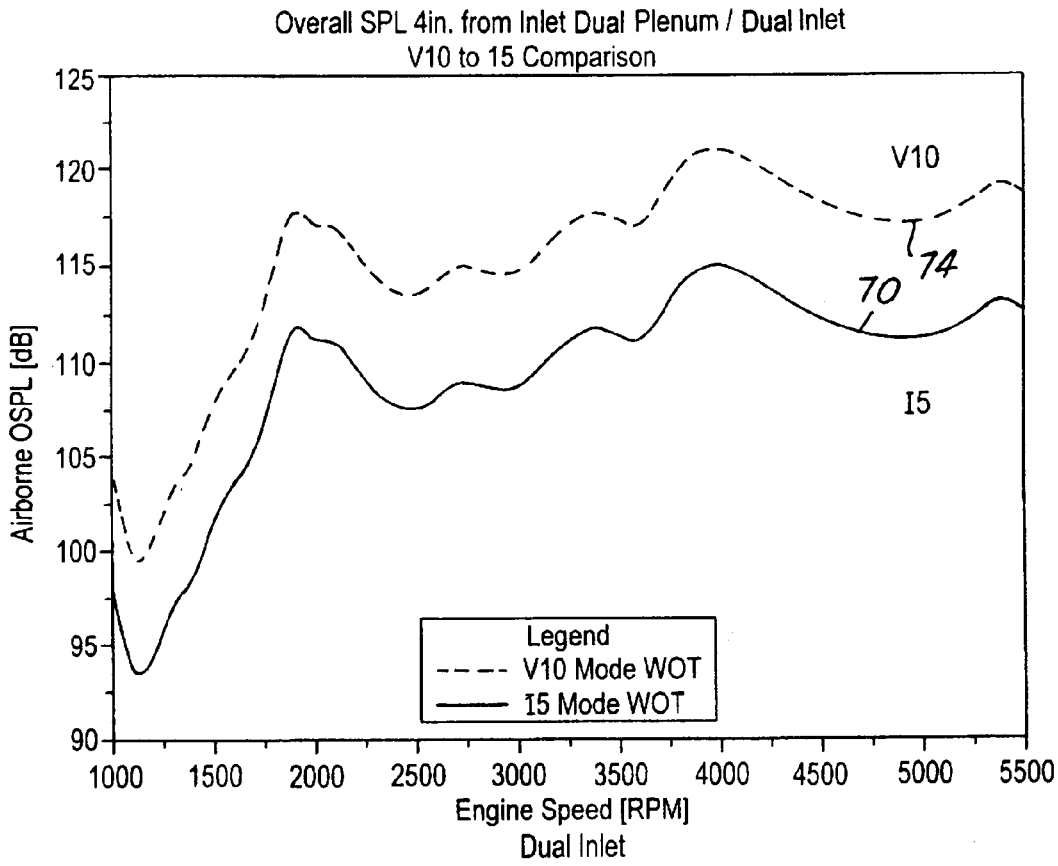
FIG. 6 is a graph similar to that of FIG. 5 illustrating a variable displacement V-10 engine having dual plenums and dual outlets.
Figure 7:
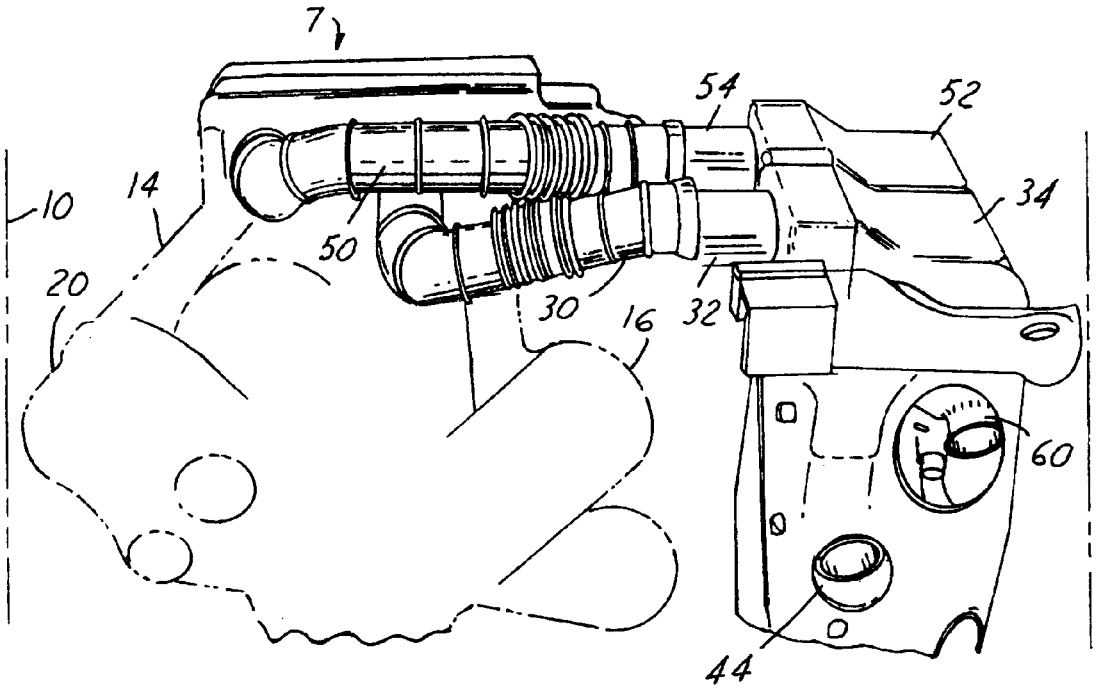
FIG. 7 is a front elevational perspective view of the vehicle engine shown in FIG. 1.
Figure 8:
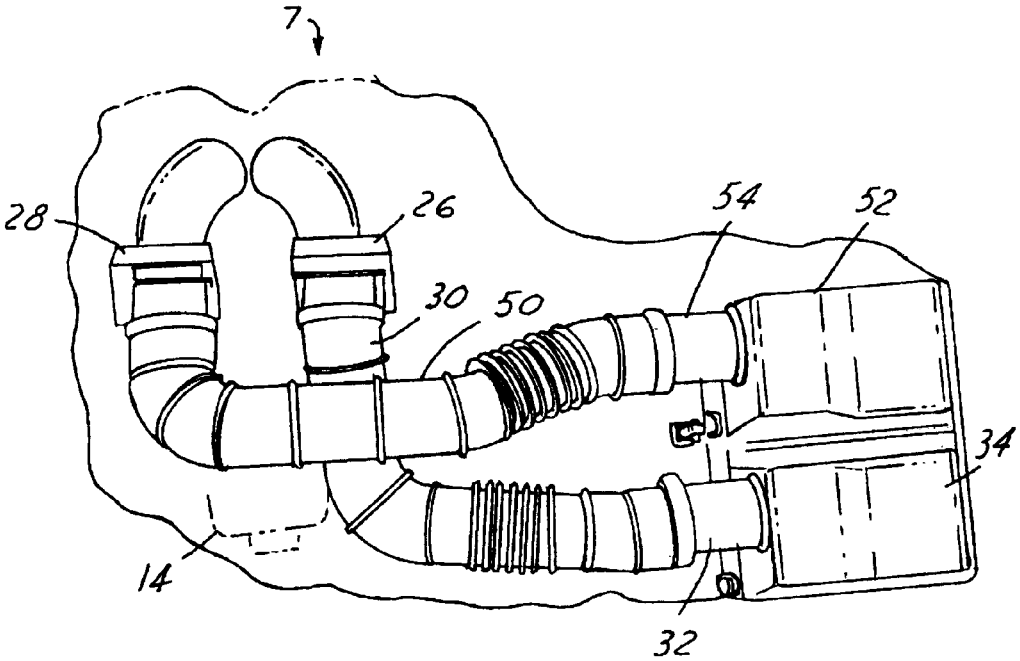
FIG. 8 is a top elevational view of the vehicle engine shown in FIGS. 1 and 7.
Figure 9:
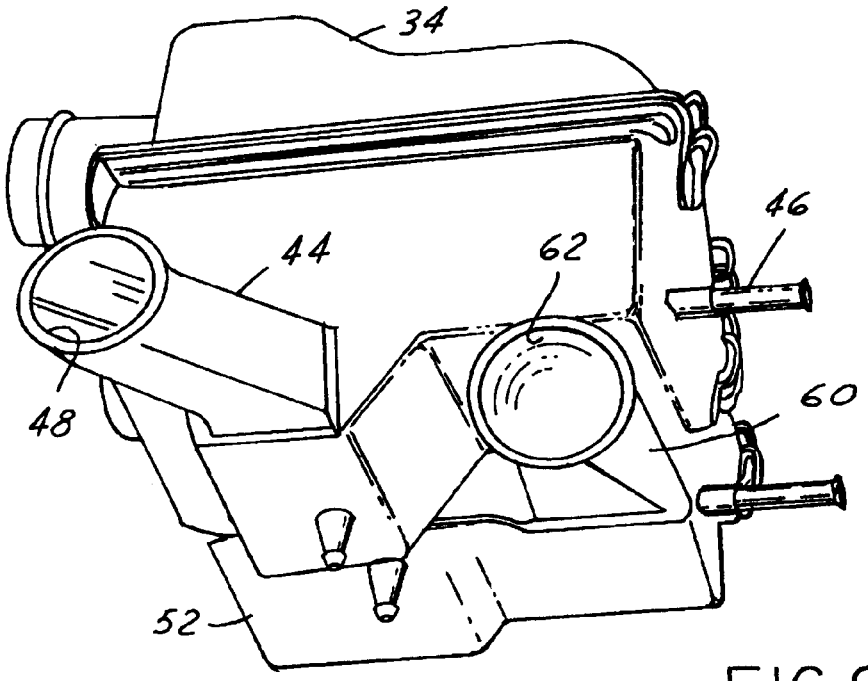
FIG. 9 is a bottom perspective view of the inlets and air filter housings shown in FIGS. 7 and 8.
Figure 10:
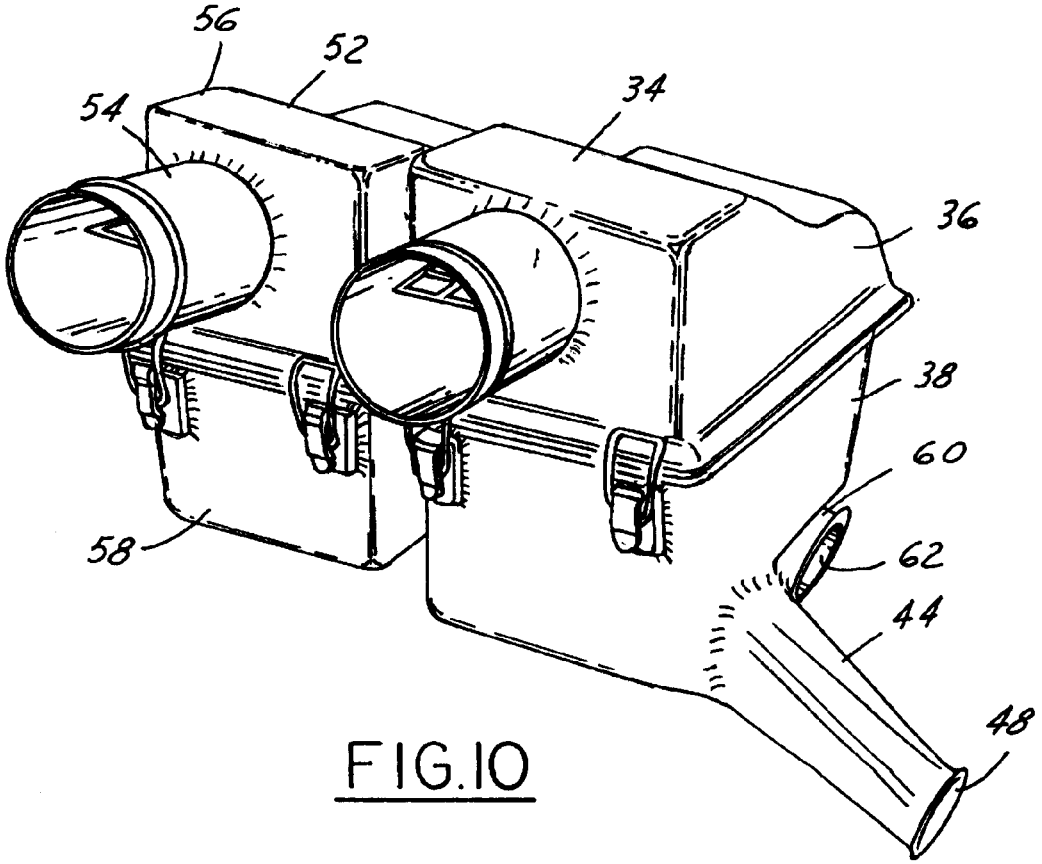
FIG. 10 is a side perspective view of the inlets and air filter housings shown in FIG. 9.
Figure 11:
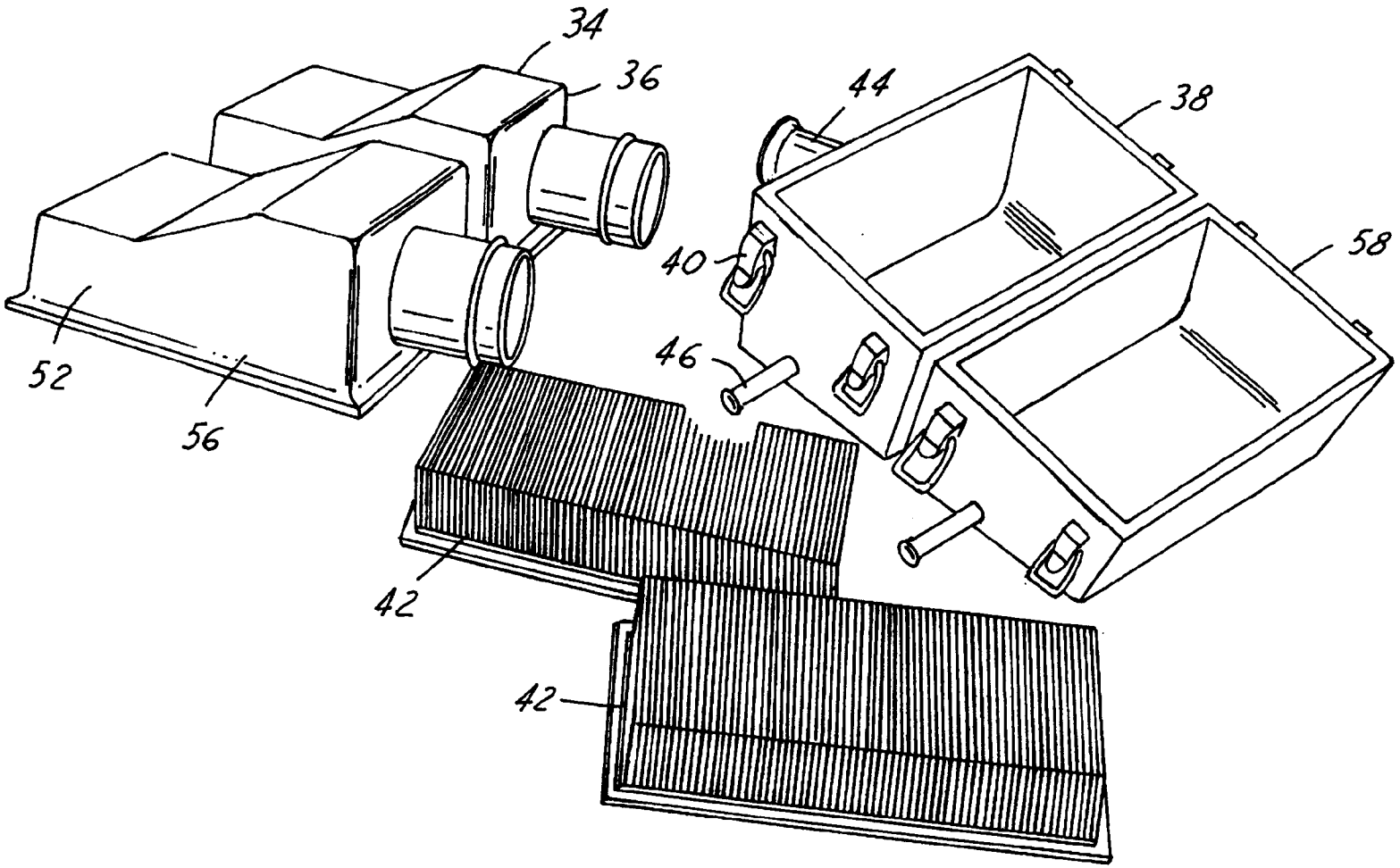
FIG. 11 is a perspective view of the inlets and air filter housings shown in FIGS. 9 and 10 with a top portion of the air filter housings being removed and the air filters being removed from the housing.

Turning to FIG. 6, the engine 14 has bank-to-bank firing which is typical for most passenger V-6, V-10 and V-12 engines and also some race car V-8 engines. The second bank of cylinders 20 will be deactivated by one of several different means, an example of which is shown and described in U.S. Pat. No. 6,237,559, Cylinder Deactivation Via Exhaust Valve Deactivation and Intake Cam Retard, commonly assigned. Accordingly, the engine 14 will be operating with a first bank of cylinders 16.

Air is induced into the first plenum 22 via the first inlet snorkel 44 and the first throttle 26. The acoustic output of the engine will typically follow line 70 in FIG. 6 wherein the engine will essentially sound like an I5 engine operation. When more power is demanded of the engine, the second bank of cylinders 20 will be activated. This will cause the engine 14 to operate under its V-10 mode of operation.

Air will also be induced into the second plenum 24 via the second throttle 28 and through the second inlet snorkel 60. The first inlet snorkel 44 has an opening 48 which is smaller than the opening 62. Accordingly, the first inlet snorkel 44 has an acoustic output which is approximately 13 decibels less than the second inlet snorkel 60. The lower acoustic output or sound pressure of the first inlet snorkel 44 reduces the cancellation of the acoustic output of the two inlet snorkels with one another. Accordingly, the I5 engine sound is retained. Ideally, transition from I5 mode to V-10 mode will be virtually imperceptible to a vehicle occupant.

Referring to FIG. 6, the actual sound output will be underneath line 74 since in the V-10 mode of operation, the engine will not be in wide open throttle. As the vehicle reaches cruising speed the second bank 20 is again deactivated, a transition will be made and such transition will again be virtually imperceptible to the vehicle occupant. Accordingly, in all stages of operation, the vehicle will sound similar when both the first and second banks 16, 20 are operating as if the engine is operating with only the first bank having an I5 sound and giving a quality roaring sound during vehicle acceleration.

The reduction of cancellation is virtually constant since the reduction in opening 48 diameter causes the acoustic reduction in sound when compared with the sound emanating from the inlet snorkel 62, to be constant over the rotational speed range of the engine 14.

Figure 2:
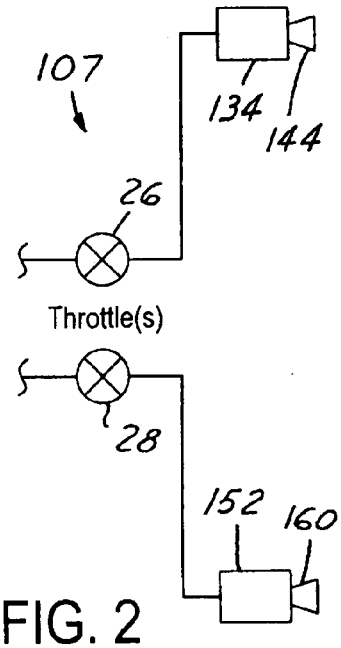
FIG. 2 is a partial view along an alternative preferred embodiment air induction arrangement to that shown in FIG. 1.
Figure 3:
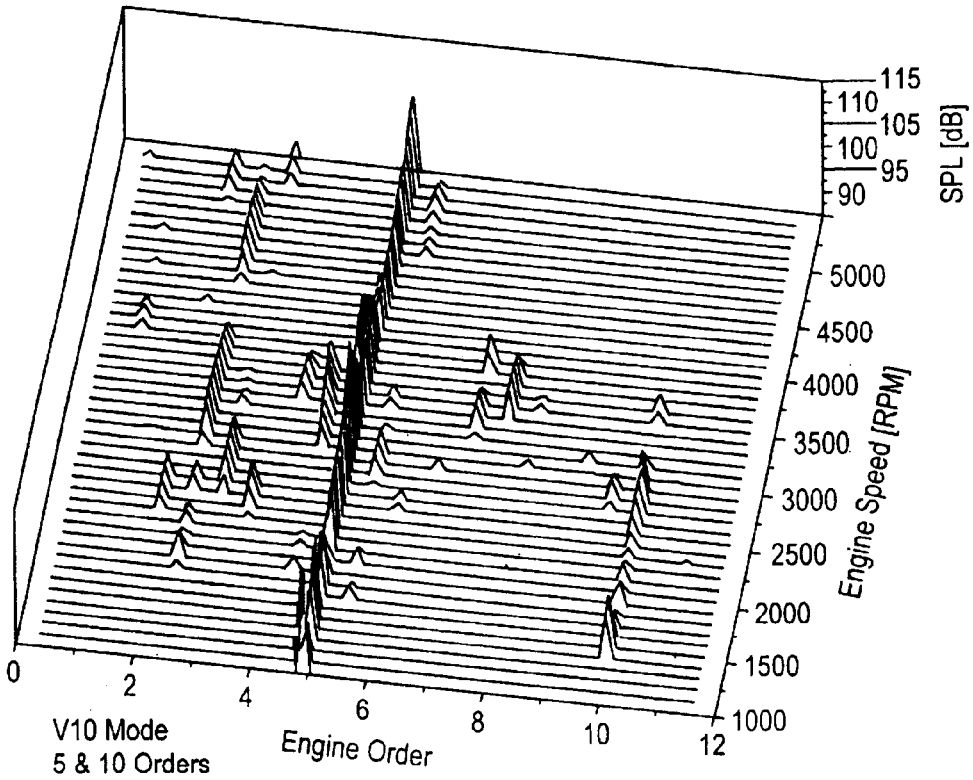
FIG. 3 is a waterfall diagram illustrating the acoustic output of a V-10 reciprocating piston internal combustion engine.
Figure 4:
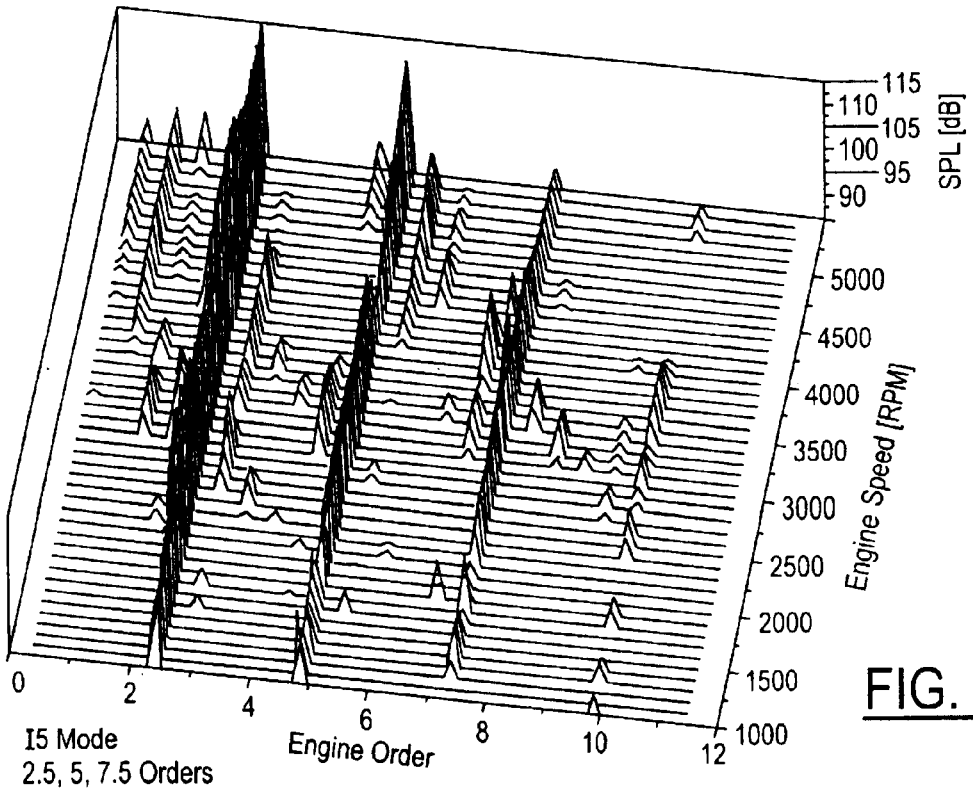
FIG. 4 is a waterfall diagram illustrating the acoustic output of an I5 reciprocating piston internal combustion engine.
Figure 5:
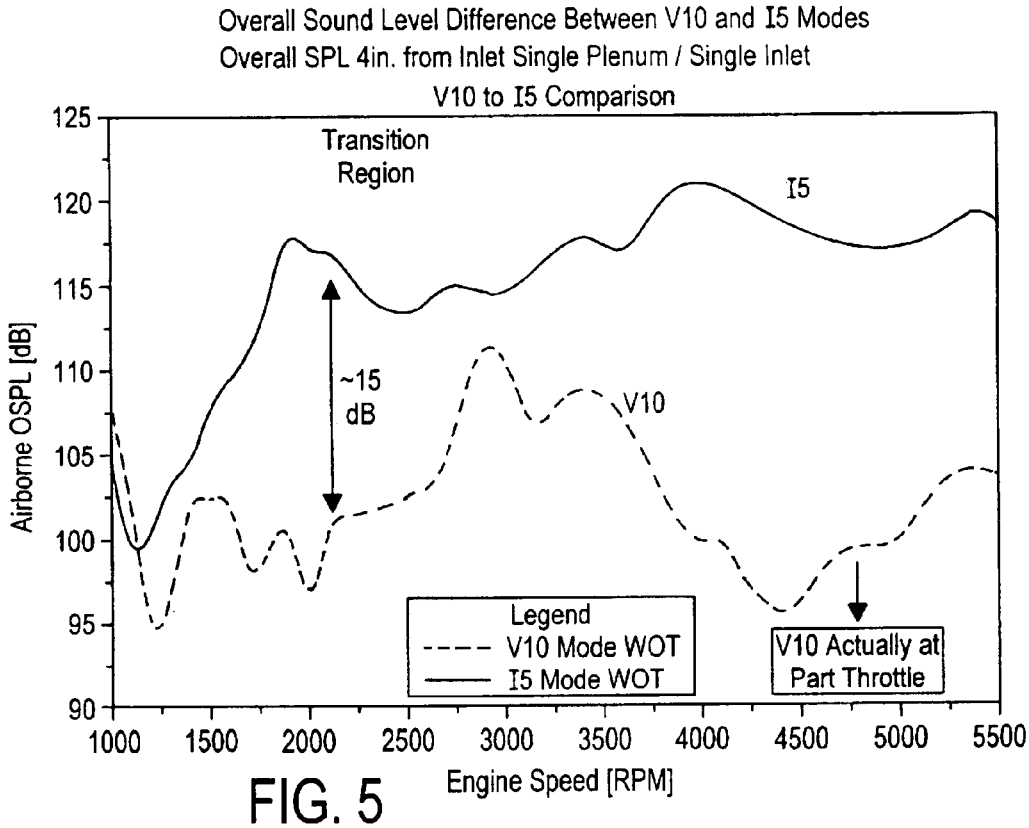
FIG. 5 is a graph illustrating sound level differential between a variable displacement V-10 engine at I5 and V-10 modes of operation utilizing a single plenum and a single inlet.

Referring to FIG. 2, an alternate preferred embodiment 107 according to the present invention is provided. The first and second air filter housings 134, 152 have inlet snorkels 144, 160 which are identical. The reduction of acoustic cancellation between the outputs of the inlet snorkels 144, 160 is achieved by symmetrical separation of the inlet snorkels 144, 160 rather than through a reduction of the sound output of either of the inlet snorkels 144, 160. From the perspective of the vehicle occupant or driver, the acoustic cancellation which would cause the sound quality to approach that of a normal V-10 engine is reduced and accordingly, the engine sounds like an I5 whether it is in full (V-10) or partial (I5) operation. The arrangement of the first and second plenums and the first and second throttles 26, 28 are as previously described. The embodiment 107 in most instances is superior, however, packaging constraints may not allow such an inlet placement arrangement.

While preferred embodiments of the present invention have been disclosed, it is to be understood that they have been disclosed by way of example only and that various modifications can be made without departing from the spirit and scope of the invention as it is encompassed by the following claims.

What is claimed is:

1. A method of operating a multiple cylinder bank selectively deactivatable cylinder variable displacement engine comprising:

operating said engine with a first group of cylinders connected to a first plenum;

selectively operating said engine with a second group of cylinders connected to a second plenum;

inducing air into said first plenum via a first inlet and a first throttle when said engine is operating with said first group of cylinders;

additionally inducing air into said second plenum via a second inlet and a second throttle when said engine is operating with said first and second groups of cylinders; and reducing cancellation of acoustic output of said first and second inlets so that said acoustic output resembles a sound of an engine operating with only said first group of cylinders when said engine is operating with said first and second groups of cylinders.

2. A method as described in claim 1, wherein said engine fires bank-to-bank when said engine is operating with said first and second groups of cylinders.

3. A method as described in claim 1, wherein reducing cancellation of acoustic output of said first and second inlets is achieved by symmetrically separating said first and second inlets within an engine compartment of a vehicle.

4. A method as described in claim 1, wherein reducing cancellation of acoustic output of said first and second inlets is achieved by reducing the sound output of one of said inlets.

5. A method as described in claim 4, wherein said first inlet sound output is reduced.

6. A method as described in claim 4, wherein said reduction of sound output is achieved by reducing an intake diameter of one of said inlets.

7. A method as described in claim 5, further including selecting a diameter of said first inlet to be smaller than a diameter of said second inlet.

8. A method as described in claim 1, wherein a transition of said engine between operating said first group of cylinders and said first and second groups of cylinders is generally acoustically imperceptible.

9. An air induction arrangement for a variable displacement reciprocating piston engine comprising:

a first inlet connected to a first group of cylinders of said engine via a first throttle and a first plenum;

a second inlet connected to a second group of cylinders of said engine via a second throttle and a second plenum; and wherein said acoustic output of one of said first and second inlets is selected to be lower to reduce acoustic cancellation between said first and second inlet acoustic outputs so that said acoustic output of said engine generally resembles a sound of said engine operating only said first group of cylinders when said first and second groups of cylinders are operating.

10. An air induction arrangement as described in claim 9, wherein one of said inlets has a diameter smaller than a diameter of said other inlet.

11. An air induction arrangement as described in claim 10, wherein said inlet with said lower acoustic output has a smaller diameter than said other inlet.

12. An air induction arrangement as described in claim 9, wherein said first inlet has an acoustic output which is selected to be lower.

13. An air induction arrangement as described in claim 9, wherein said first inlet has a smaller diameter than said second outlet.

14. An air induction arrangement as described in claim 9, wherein said lowered acoustic output generally occurs over a major portion of the rotational speed range of said engine.

15. An arrangement of an automotive vehicle with a selectively deactivitable cylinder variable displacement reciprocating piston engine comprising:

a first group of engine cylinders connected to a first plenum;

a second group of engine cylinders connected to a second plenum;

a first inlet connected via a first throttle to said first plenum for providing air to said first group of cylinders when said engine is operating with said first group of cylinders;

a second inlet connected via a second throttle to said second plenum for providing air to said second group of cylinders when said engine is additionally operating with said second group of cylinders and wherein said first and second inlets have reduced acoustic output cancellation allowing said engine to sound like an engine operating with only said first group of cylinders when said engine is operating with said first and second groups of cylinders.

16. An arrangement of an automotive vehicle as described in claim 15, wherein said first and second inlets are symmetrically separated within an engine compartment of a vehicle to reduce acoustic cancellation between said first and second inlets.

17. An arrangement of an automotive vehicle as described in claim 15, wherein at least one of said inlets has a lower acoustic output than said other inlet.

18. An arrangement of an automotive vehicle as described in claim 17, wherein said inlet with a reduced acoustic output has a generally reduced acoustic output over a major portion of the rotational speed range of said engine.

19. An arrangement of an automotive vehicle as described in claim 17, wherein said first inlet has said lower acoustic output.

20. An arrangement of automotive vehicle as described in claim 17, wherein said inlet with lower acoustic output has a smaller diameter than said other inlet.

21. An arrangement of an automotive vehicle as described in claim 20, wherein said first inlet has a smaller diameter than said second inlet.

22. An arrangement of an automotive vehicle as described in claim 15, wherein said engine is a bank-to-bank firing engine.

23. An arrangement of an automotive vehicle as described in claim 22, wherein said engine is a V-block engine.

24. A method of operating a multiple cylinder bank variable displacement engine comprising:

operating said engine with a first group of cylinders connected to a first plenum;

selectively operating said engine with a second group of cylinders connected to a second plenum;

inducing air into said first plenum via a first inlet and a first throttle when said engine is operating with said first group of cylinders;

additionally inducing air into said second plenum via a second inlet and a second throttle when said engine is operating with said first and second groups of cylinders; and reducing cancellation of acoustic output of said first and second inlets so that said acoustic output resembles a sound of an engine operating with only said first group of cylinders when said engine is operating with said first and second groups of cylinders, said reducing of acoustic output being achieved by reducing the sound output of one of said inlets.

25. A method as described in claim 24, wherein said first inlet sound output is reduced.

26. A method as described in claim 24, wherein said reduction of sound output is achieved by reducing an intake diameter of one of said inlets.

27. A method as described in claim 25, further including selecting a diameter of said first inlet to be smaller than a diameter of said second inlet.

28. A method as described in claim 24, wherein a transition of said engine between operating said first group of cylinders and said first and second groups of cylinders is generally acoustically imperceptible.

29. An arrangement of an automotive vehicle with a variable displacement reciprocating piston engine comprising:

a first group of engine cylinders connected to a first plenum;

a second group of engine cylinders connected to a second plenum;

a first inlet connected via a first throttle to said first plenum for providing air to said first group of cylinders when said engine is operating with said first group of cylinders;

a second inlet connected via a second throttle to said second plenum for providing air to said second group of cylinders when said engine is additionally operating with said second group of cylinders and wherein at least one of said inlets has a lower acoustic output then said other inlet so that said first and second inlets have reduced acoustic output cancellation showing said engine to sound like an engine operating with only said first group of cylinders when said engine is operating with said first and second groups of cylinders.

30. An arrangement of an automotive vehicle as described in claim 29, wherein said inlet with a reduced acoustic output has a generally reduced acoustic output over a major portion of the rotational speed range of said engine.

31. An arrangement of an automotive vehicle as described in claim 29, wherein said first inlet has said lower acoustic output.

32. An arrangement of automotive vehicle as described in claim 29, wherein said inlet with lower acoustic output has a smaller diameter than said other inlet.

33. An arrangement of an automotive vehicle is described in claim 32, wherein said first inlet has a smaller diameter than said second inlet.

34. An arrangement of an automotive vehicle as described in claim 29, wherein said engine is a bank-to-bank firing engine.

35. An arrangement of an automotive vehicle as described in claim 34, wherein said engine is a V-block engine.

* * * * *